US010809033B2

(12) United States Patent
Tindal

(10) Patent No.: US 10,809,033 B2
(45) Date of Patent: Oct. 20, 2020

(54) FIREARM COMPENSATOR

(71) Applicant: Michael P. Tindal, Owensville, MO (US)

(72) Inventor: Michael P. Tindal, Owensville, MO (US)

( * ) Notice: Subject to any disclaimer, the term of this patent is extended or adjusted under 35 U.S.C. 154(b) by 0 days.

(21) Appl. No.: 16/204,923

(22) Filed: Nov. 29, 2018

(65) Prior Publication Data

US 2020/0025500 A1 Jan. 23, 2020

Related U.S. Application Data

(60) Provisional application No. 62/592,268, filed on Nov. 29, 2017.

(51) Int. Cl.
*F41A 21/36* (2006.01)

(52) U.S. Cl.
CPC ..... *F41A 21/36* (2013.01)

(58) Field of Classification Search
CPC ..... F41A 21/18; F41A 21/26; F41A 21/28; F41A 21/36; F41A 21/30; F41A 21/32; F41A 21/325; F41A 21/34; F41A 21/38
USPC ..... 89/14.3
See application file for complete search history.

(56) References Cited

U.S. PATENT DOCUMENTS 785,972 A 3/1905 McClean
785,975 A 3/1905 McClean
786,230 A 3/1905 McClean
812,140 A 2/1906 Kent
1,190,107 A 7/1916 Carroll
1,229,675 A 6/1917 Thompson
1,315,504 A 9/1919 Humm
2,668,479 A 2/1954 Batten
2,916,970 A * 12/1959 Mutter ..... F41A 21/00 89/14.3
2,935,000 A 5/1960 Mowrey
3,177,771 A 4/1965 McKim
3,483,794 A 12/1969 Packard
3,611,867 A * 10/1971 Silsby ..... F42B 5/035 89/14.05
3,665,804 A 5/1972 Rohr
3,858,481 A * 1/1975 Elliott ..... F41A 21/28 89/14.3
3,978,762 A 9/1976 Khaidurov
4,058,050 A * 11/1977 Brouthers ..... F41A 21/36 89/14.3
4,126,077 A 11/1978 Quesnel
(Continued)

*Primary Examiner* — Stephen Johnson
*Assistant Examiner* — Benjamin S Gomberg
(74) *Attorney, Agent, or Firm* — David E. Crawford; Crawford IP Law

(57) ABSTRACT

A firearm component including a barrel having a bore extending to a generally circular aperture at a forward end of the barrel. The barrel has a series of compensator slots spaced at equal intervals along the bore. Each slot has an oblong cross section extending through the barrel from an interior surface to an exterior surface having a major axis and a minor axis. The cross section also has a length measured along the major axis and a width measured along the minor axis that is shorter than the length. The interval between each adjacent pair of slots in said series of compensator slots has a width greater than the width of each slot in the adjacent pair. At least a portion of the cross section extends below the central bore axis.

24 Claims, 24 Drawing Sheets

(56) References Cited

U.S. PATENT DOCUMENTS

| | | | | | |
|---|---|---|---|---|---|
| 4,322,999 | A * | 4/1982 | Aston | F41A 21/36 | 89/14.3 |
| 4,353,181 | A | 10/1982 | Pedgonay | | |
| 4,534,264 | A * | 8/1985 | Tarnoff | F41A 21/28 | 89/14.3 |
| 4,691,614 | A | 9/1987 | Leffel | | |
| 4,811,648 | A | 3/1989 | Blackwell | | |
| 4,833,808 | A | 5/1989 | Strahan | | |
| 4,930,397 | A * | 6/1990 | Seidler | F41A 21/325 | 89/14.3 |
| 4,942,801 | A | 7/1990 | Schuemann | | |
| 4,976,184 | A * | 12/1990 | Bunczk | F41A 21/36 | 89/14.3 |
| 5,033,356 | A * | 7/1991 | Richardson | F41A 21/30 | 181/223 |
| 5,036,747 | A * | 8/1991 | McClain, III | F41A 21/36 | 89/14.3 |
| 5,076,137 | A | 12/1991 | Paredes | | |
| 5,136,923 | A | 8/1992 | Walsh | | |
| 5,225,615 | A | 7/1993 | Talbot | | |
| 5,305,678 | A | 4/1994 | Talbot | | |
| 5,367,940 | A | 11/1994 | Taylor | | |
| 5,549,030 | A | 8/1996 | Lespron | | |
| 5,563,362 | A | 10/1996 | York | | |
| 5,587,549 | A * | 12/1996 | Clouse | F41A 21/36 | 89/14.3 |
| 5,675,107 | A | 10/1997 | Ledys | | |
| 5,811,714 | A * | 9/1998 | Hull | F41A 21/36 | 89/14.3 |
| 5,844,162 | A | 12/1998 | Renner | | |
| 6,079,311 | A | 6/2000 | O'Quinn | | |
| 6,308,609 | B1 | 10/2001 | Davies | | |
| 6,425,310 | B1 | 7/2002 | Champion | | |
| 6,604,445 | B2 * | 8/2003 | Sevastian | F41A 21/36 | 42/1.06 |
| 6,796,214 | B2 | 9/2004 | Hausken | | |
| 6,820,530 | B2 * | 11/2004 | Vais | F41A 21/36 | 89/14.3 |
| 6,899,008 | B2 | 5/2005 | Breuer | | |
| 7,032,339 | B1 * | 4/2006 | Bounds | F41A 21/36 | 42/1.06 |
| 7,328,645 | B1 | 2/2008 | Curry | | |
| 8,087,337 | B1 | 1/2012 | Cary | | |
| 8,485,082 | B1 | 7/2013 | Masaki | | |
| 9,207,034 | B2 | 12/2015 | Larson | | |
| 9,395,135 | B2 | 7/2016 | Randazzo | | |
| 9,441,901 | B1 | 9/2016 | Harrison | | |
| 9,482,484 | B2 | 11/2016 | Barney | | |
| 9,541,345 | B2 | 1/2017 | Schwartzkopf | | |
| 9,593,900 | B2 | 3/2017 | Vossier | | |
| 10,508,877 | B2 * | 12/2019 | Peknik | F41A 21/30 | |
| 2014/0075800 | A1 | 3/2014 | Morris | | |
| 2016/0003570 | A1 | 1/2016 | Tonkin | | |
| 2016/0109204 | A1 | 4/2016 | Leone | | |
| 2016/0123689 | A1 | 5/2016 | Maeda | | |
| 2016/0161203 | A1 | 6/2016 | Wilson | | |
| 2016/0169606 | A1 | 6/2016 | Joplin | | |
| 2016/0202012 | A1 | 7/2016 | Kokinis | | |
| 2016/0341509 | A1 * | 11/2016 | Xu | F41A 21/16 | |

* cited by examiner

FIREARM COMPENSATOR

CROSS-REFERENCE TO RELATED APPLICATION

The present application claims priority to U.S. Provisional Patent Application 62/592,268 filed Nov. 29, 2017, which is hereby incorporated by reference in its entirety.

BACKGROUND

The present invention relates to firearm components, and more particularly, to a firearm component providing a compensator for reducing undesirable loads, such as muzzle rise, that firearms impose on users.

Compensators are well known and used on handguns and rifles. When a user shoots a firearm, high-pressure gases push a bullet through the barrel at high speed. The pressure also causes a recoil force that pushes the gun toward the shooter. This force, which is proportional to the caliber of the bullet and pressure developed behind the bullet, is directed along the barrel. Because the grip of a handgun (or the stock of a rifle) is below the barrel, the gun imposes both a force and a moment on the user. The force pushes directly rearward on the user's hand, and the moment torques the user's hand, so the front end of the handgun tends to move upward and off target. This upward motion is often called muzzle rise. Because the user must realign the handgun with the target before taking another shot, muzzle rise increases the time required between repeated shots. Further, the recoil force and muzzle rise moment fatigue the user, discouraging users from shooting the handgun repetitively over extended periods. Moreover, repeatedly being subjected to recoil and muzzle rise can cause users to respond involuntarily to compensate for these loads, moving the firearm off target.

Conventional compensators include combinations of expansion chambers, baffles, and ports. Expansion chambers allow gases to expand before the bullet leaves the barrel. The expanding gas reduces the pressure in the barrel, which reduces the recoil. Baffles separate expansion chambers. Gases expanding into a chamber impact the baffle. The impact is normally greater on the downstream face of the baffle, causing loads on the barrel in a direction generally opposite the recoil force. Usually, the greatest recoil reduction achieved by compensators results from gases impacting baffles before the bullet exits the firearm. Ports provided in the interior and the exterior of the firearm direct gases escaping from the barrel and/or the expansion chambers. Ports extending from the interior of the barrel not only allow gases to expand, reducing recoil force but also provide downstream surfaces that are impacted by the expanding gas, counteracting muzzle rise moment. Ports venting gases from the top of the firearm direct propulsive forces downward opposing muzzle rise. Depending upon the configuration of expansion chambers, baffles, and ports, the propulsive forces and impact forces created by gases escaping the barrel are delayed, extending the duration of recoil and reducing the peak forces applied. Thus, the particular configuration of expansion chambers, baffles, and ports can significantly affect compensator performance.

There are advantages and disadvantages to conventional compensators. Some conventional compensators direct sound, flash, pressure waves, and/or smoke containing lead toward the user and bystanders. Further, compensators frequently add length and weight to the end of the firearm, increasing potential user fatigue. Still further, in some cases compensators decrease accuracy and/or precision of the firearm. Thus, there remains a need for a compensator that reduces one or more of these disadvantages inherent in conventional compensators.

The specification describes some features resulting from the improvement described below, and other features should be apparent to those skilled in the art from the description.

SUMMARY

In one aspect, the present disclosure includes a firearm component comprising an elongate barrel having a generally cylindrical interior surface defining a bore extending along a central bore axis to a generally circular aperture at a forward end of the barrel through which a projectile is shot when the firearm is fired. The bore and aperture share a common bore diameter. The interior surface has a helical rifling groove extending along the interior surface around the central bore axis. The barrel has a series of compensator slots spaced at equal intervals along the bore. Each compensator slot in the series of compensator slots has an oblong cross section extending through the barrel from the interior surface to an exterior surface of the barrel allowing gases to travel through the slot from the bore when the firearm is fired. The cross section has a major axis extending transverse to the central bore axis and a minor axis extending transverse to the major axis and parallel to the central bore axis. The cross section also has a length measured along the major axis at the interior surface of the barrel and a width measured along the minor axis at the interior surface of the barrel that is shorter than the length. The interval between each adjacent pair of slots in the series of compensator slots has a width at the interior surface of the barrel greater than the width of each slot in the adjacent pair of slots. The helical rifling groove extends to the aperture, and at least a portion of the cross section extends below the central bore axis.

In another aspect, the present disclosure includes a firearm component comprising an elongate barrel having a generally cylindrical interior surface defining a bore extending along a central bore axis to a generally circular aperture at a forward end of the barrel through which a projectile is shot when the firearm is fired. The bore and aperture share a common bore diameter. The interior surface has a helical rifling groove extending along the interior surface around the central bore axis to the aperture. The barrel has a first series of compensator slots spaced at intervals along the bore and a second series of compensator slots spaced at intervals along the bore. Each slot in the second series of compensator slots is positioned on an opposite side of an imaginary plane that includes the central bore axis. Each compensator slot in the first and second series of compensator slots has a racetrack-shaped cross section extending through the barrel from the interior surface to an exterior surface of the barrel allowing gases to travel through the slot from the bore when the firearm is fired. The cross section has a major axis extending transverse to the central bore axis and a minor axis extending transverse to the major axis and parallel to the central bore axis. Further, the cross section has a length measured along the major axis at the interior surface of the barrel that is greater than about sixty percent of the bore diameter and a width measured along the minor axis at the interior surface of the barrel that is less than about seventy percent of the bore diameter. The width is shorter than the length.

In yet another aspect, the present disclosure includes a firearm component comprising an elongate barrel having a generally cylindrical interior surface defining a bore extending along a central bore axis to a generally circular aperture at a forward end of the barrel through which a projectile is shot when the firearm is fired. The bore and aperture share a common bore diameter. The interior surface has a helical rifling groove extending along the interior surface around the central bore axis to the aperture. The barrel has a series of compensator slots spaced at intervals along the bore. Each compensator slot in the series of compensator slots has an oblong cross section extending through the barrel along a slot axis from the interior surface to an exterior surface of the barrel allowing gases to travel through the slot from the bore when the firearm is fired. Each compensator slot in the series of compensator slots has a forward slot face extending radially from the interior surface to an exterior surface of the barrel and a rearward slot face opposite the forward slot face extending parallel to the forward slot face. The cross section of each compensator slot in the series of compensator slots has a major axis extending transverse to the central bore axis and a minor axis extending transverse to the major axis and parallel to the central bore axis. In addition, the cross section of each compensator slot in the series of compensator slots has a length measured along the major axis at the interior surface of the barrel and a width measured along the minor axis at the interior surface of the barrel that is shorter than the length. At least a portion of the cross section extends below the central bore axis.

In still another aspect, the present disclosure includes a firearm component comprising an elongate barrel having a generally cylindrical interior surface defining a bore extending along a central bore axis to a generally circular aperture at a forward end of the barrel through which a projectile is shot when the firearm is fired. The bore and aperture share a common bore diameter. The interior surface has a helical rifling groove extending along the interior surface around the central bore axis to the aperture. The barrel has a series of compensator slots spaced at intervals along the bore. The series is aligned in a line extending parallel to the central bore axis. Each compensator slot in the series of compensator slots has an oblong cross section extending through the barrel from the interior surface to an exterior surface of the barrel allowing gases to travel through the slot from the bore when the firearm is fired. The cross section has a major axis extending transverse to the central bore axis and a minor axis extending transverse to the major axis and parallel to the central bore axis. Further, the cross section has a length measured along the major axis at the interior surface of the barrel and a width measured along the minor axis at the interior surface of the barrel that is less than the length. The firearm component also comprises a housing releasably connected to the elongate barrel. The housing has a cylindrical surface partially defining a void sized for receiving the forward portion of the elongate barrel. The void has a void axis extending coaxially with the central bore axis of the barrel when the housing is connected to the barrel. The housing has a series of circumferentially oriented housing grooves spaced at intervals along the void. One housing groove of the series of housing grooves axially overlaps one compensator slot of the series of compensator slots allowing gas in the bore to travel outward through the overlapped compensator slot and into the overlapping housing groove.

And, in another aspect, the present disclosure includes a firearm component comprising an elongate barrel having a generally cylindrical interior surface defining a bore extending along a central bore axis to a generally circular aperture at a forward end of the barrel through which a projectile is shot when the firearm is fired. The bore and aperture share a common bore diameter. The interior surface has a helical rifling groove extending along the interior surface around the central bore axis to the aperture. The barrel has a series of compensator slots spaced at intervals along the bore. The series is aligned in a line extending parallel to the central bore axis. Each compensator slot in the series of compensator slots has an oblong cross section extending through the barrel from the interior surface to an exterior surface of the barrel allowing gases to travel through the slot from the bore when the firearm is fired. The cross section has a major axis extending transverse to the central bore axis and a minor axis extending transverse to the major axis and parallel to the central bore axis. Moreover, the cross section has a length measured along the major axis at the interior surface of the barrel and a width measured along the minor axis at the interior surface of the barrel that is less than the length. The barrel also includes a series of annular ribs spaced at intervals along the barrel. Each pair of adjacent ribs in the series of defines a recess into which at least one compensator slot of the series of compensator extends allowing gas in the bore to travel outward through the slot into the recess. The firearm component further comprises a slide for chambering the projectile in line with the barrel bore in preparation for firing the firearm. The slide includes a forward portion having a surface sized and shaped to receive the barrel and cover the recesses.

Other aspects of the present disclosure will be apparent in view of the following description and claims

BRIEF DESCRIPTION OF THE DRAWINGS

Corresponding reference characters indicate corresponding parts throughout the drawings.

DETAILED DESCRIPTION

Figure 1:
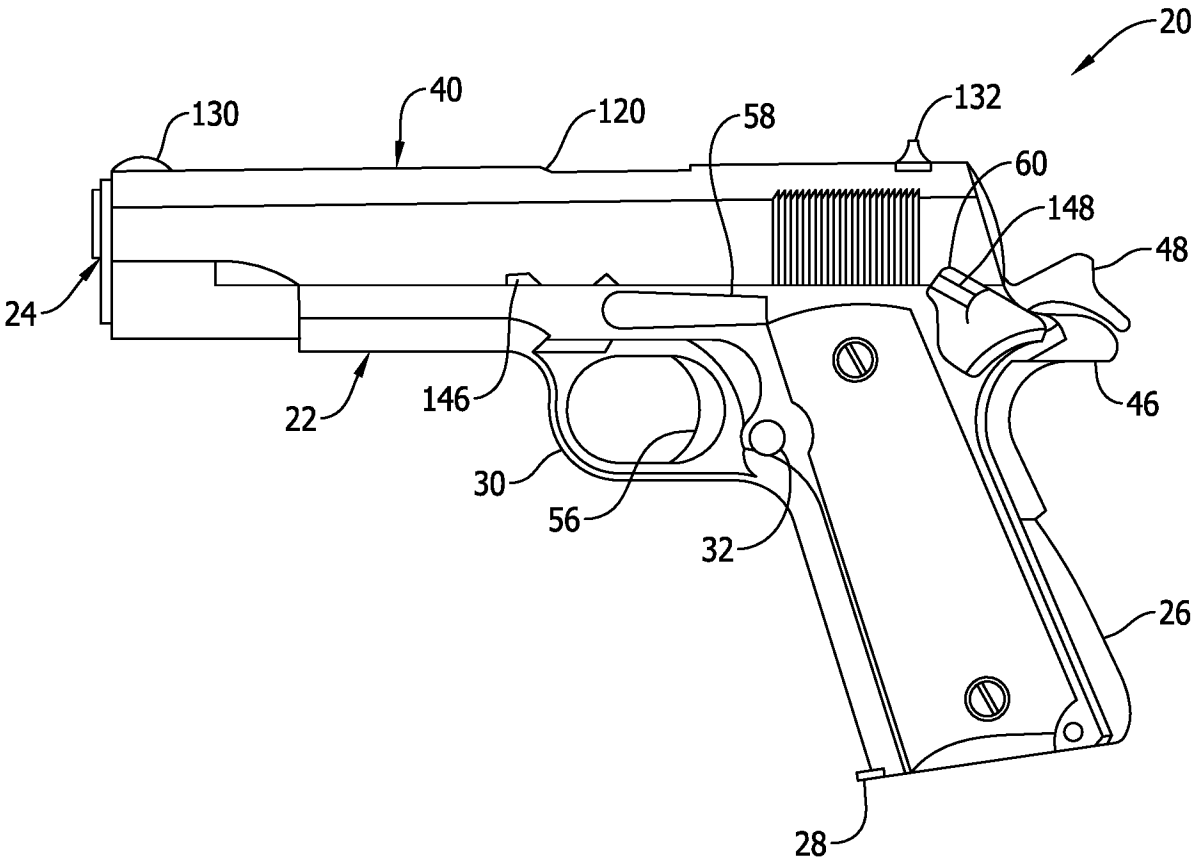
FIG. 1 (PRIOR ART)
FIG. 1 is a side elevation of a conventional firearm.
Figure 2:
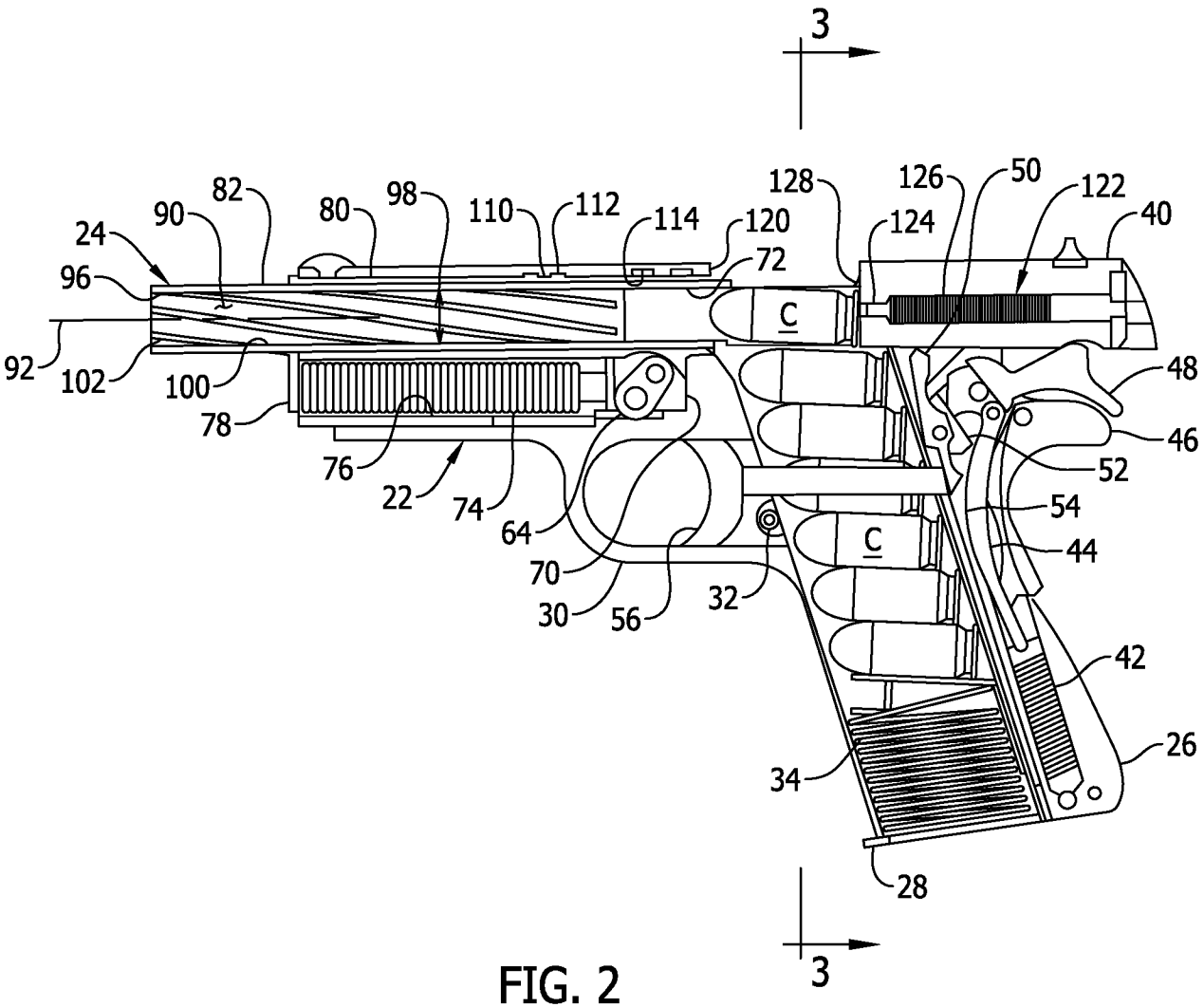
FIG. 2 (PRIOR ART)
FIG. 2 is a cross section of the conventional firearm.

Referring to the drawings, FIGS. 1 and 2 illustrate a firearm, generally designated by the reference number 20. The illustrated firearm is an M1911 single-action, semi-automatic, magazine-fed, recoil-operated handgun. Those skilled in the art will appreciate that the features described below apply to firearms of other types.

The firearm 20 includes a frame, generally designated by 22, housing a barrel, generally designated by 24. The frame 22 includes a grip 26 that houses a removable cartridge magazine 28 and a trigger guard 30. A magazine release 32 holds the cartridge magazine 28 in place in the grip 26. As shown in FIG. 2, the cartridge magazine 28 includes a cartridge spring 34 that biases cartridges C upward. A slide, generally designated by 40, is removably connected to the frame 22. The grip 26 also houses a main spring assembly 42, a hammer strut 44, a grip safety 46, a hammer 48, a disconnector 50, a sear 52, a sear spring 54, and a trigger 56. Moreover, the frame 22 includes a selectively rotatable slide stop 58 and a selectively rotatable slide lock safety 60. A link 64 rotatably connects the frame to a tongue 70 extending downward from the barrel 24 immediately below a cartridge chamber 72. A recoil spring assembly 74 abuts the frame 22 in front of the link 64. The recoil spring assembly 74 extends through an opening 76 in the slide 40 and abuts a keeper tab 78 extending downward from a barrel bushing, generally designated by 80. The bushing 80, which releasably connects to the slide 40, surrounds an exterior surface 82 of the barrel 24 to support the forward end of the barrel when the slide moves rearward as explained below.

A bore 90 extends through the barrel 24 along an imaginary central bore axis 92 from the cartridge chamber 72 to a generally circular aperture or opening 96 at a forward end of the barrel. The bore 90 and aperture 96 share a standard bore diameter 98. A cylindrical interior surface 100 having helical rifling grooves 102 extending from the cartridge chamber 72 to the circular aperture 96 defines the bore 90. The rifling grooves 102 engage the sides of a bullet (or more broadly, a projectile) fired through the barrel 24, causing the bullet to spin about the central bore axis 92 to stabilize the bullet after it leaves the barrel. As further shown in FIG. 2, the barrel 24 includes grooves 110 extending transverse to the central bore axis 92 across the upper surface of the barrel. These grooves 110 delineate teeth 112 that engage corresponding grooves 114 extending transversely across an interior of the slide 40.

An ejection port 120 behind the transverse slide grooves 114 allows spent casings to be ejected from the firearm 20 as explained below. The slide 40 houses a firing pin assembly, generally designated by 122, positioned behind the cartridge chamber 72 of the barrel 24. The firing pin assembly 122 includes a firing pin 124 biased rearward in the slide by a firing pin spring 126. When pushed forward, the firing pin 124 extends through a breech face 128. Moreover, the slide 40 includes front and rear sights 130, 132, respectively, for aiming the firearm 20 at a target (not shown).

Figure 3:
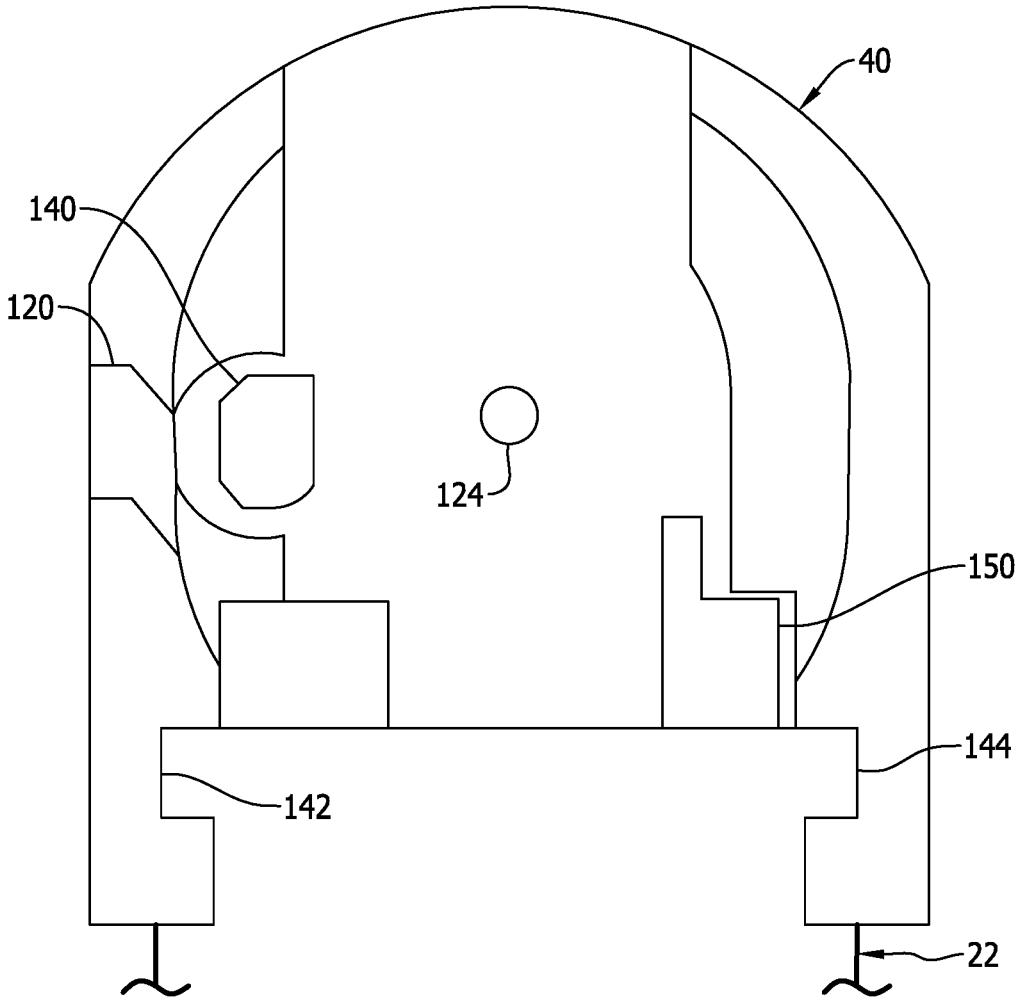
FIG. 3 (PRIOR ART)
FIG. 3 is a cross section of a conventional firearm taken in the plane of line 3-3 of FIG. 2.

As shown in FIG. 3, the slide 40 houses an extractor 140 that engages the cartridge C casing The slide also has ways that receive rails 144 on the frame 22 that guide the slide in a straight line. The slide 40 is selectively movable between a forward position shown in FIG. 1 and a rearward position shown in FIG. 2 in which the slide is displaced rearward by a distance equal to about one-quarter of an overall length of the slide. A first notch 146 (FIG. 1) formed on the slide 40 receives the slide stop 58 rotatably mounted on the frame 22 to hold the slide in the rearward position. Further, a second notch 148 formed on the slide 40 receives the slide lock safety 60 rotatably mounted on the frame 22 to hold the slide in the forward position. As further shown in FIG. 3, the frame 22 includes an ejector 150 that impacts the cartridge C as the slide 40 moves rearward, pushing the cartridge out of engagement with the extractor 140 and pivoting the cartridge through the ejection port 120. Other elements and features of the M1911 are conventional and well understood by those skilled in the art.

Cycling the slide 40 to its rearward position and back to its forward position allows a cartridge C to be pushed upward by the cartridge spring 34 and forward into the cartridge chamber 72 of the barrel 24. In this position, a rearward end of the cartridge casing abuts the breech face 74, so the primer of the cartridge C and the firing pin assembly 122 are aligned. Cycling the slide 40 also pushes the hammer 48 to a cocked position. The sear spring 54 biases the sear 52 rearward to hold the hammer in the cocked position. The user grasps the grip 26, pivoting the grip safety 46 to release the trigger 56 so the user can move the trigger rearward in the frame 22. The user aligns the front and rear sights 130, 132, respectively, (FIG. 1) with a target (not shown) and pulls the trigger 56. Pulling the trigger 56 pushes the disconnector 50 against the sear 52 to rotate the sear until the sear disengages the hammer 48, allowing the hammer to rotate forward under the influence of the main spring assembly 42 to impact the firing pin 124. The impact drives the firing pin 124 forward to the primer, which ignites powder in the cartridge C. The burning powder produces rapidly expanding gases. The expanding gases force the bullet through the bore 90 and out the aperture 96 at high speed. The expanding gases also drive the barrel 24, the slide 40 and spent casing rearward. The link 64 connecting the barrel 24 to the frame 22 pivots as the barrel moves rearward, pulling the rearward end of the barrel downward to disengage the teeth 72 of the barrel from the grooves 102 in the slide 40, allowing the slide to move further rearward. When the cartridge C reaches the ejector 150, the ejector forces the cartridge from the extractor 140 and pivots the cartridge outward through the ejection port 120. When a breech face 128 of the slide 40 passes an upper cartridge (if present) in the magazine 28, the cartridge snaps upward in the magazine under the influence of the cartridge spring 34, so the cartridge vertically overlaps the breech face 128. As the slide 40 moves rearward, the recoil spring assembly 74 is compressed, storing energy that tends to pull the slide forward. At the end of travel, the stored energy pulls the slide 40 forward on the frame 22. As the slide 40 moves forward, the breech face 128 engages the exposed cartridge C, so the slide 40 pushes the cartridge forward into the cartridge chamber 72 of the barrel 24. When the breech face 128 reaches the barrel 24, the breech face pushes the barrel forward, pivoting the link 64 and forcing the rearward end of the barrel upward to engage the teeth 112 and grooves 114 and hold the slide 40 in position with the cartridge C in the cartridge chamber 72.

As the expanding gas moves the slide 40 rearward, a rearward end of the slide also pushes the hammer 48 rearward, so it pivots toward the cocked position. The slide 40 forces the disconnector 50 downward as the slide moves rearward, releasing the sear 52 to pivot and dog the hammer 48 when it reaches the cocked position. The sear spring 54 biases the disconnector 50 forward against the trigger 56, returning the trigger to its original position before being pulled. The sear spring 54 also biases the disconnector 50 upward. The slide 40 releases the sear spring 54 to move upward when the slide reaches the forward position, so the disconnector 50 is positioned to rotate the sear 52, so it disengages the hammer 48 when the user pulls the trigger 56 again. Other aspects of the M1911 are well known and understood by those having skill in the art.

Figure 4:
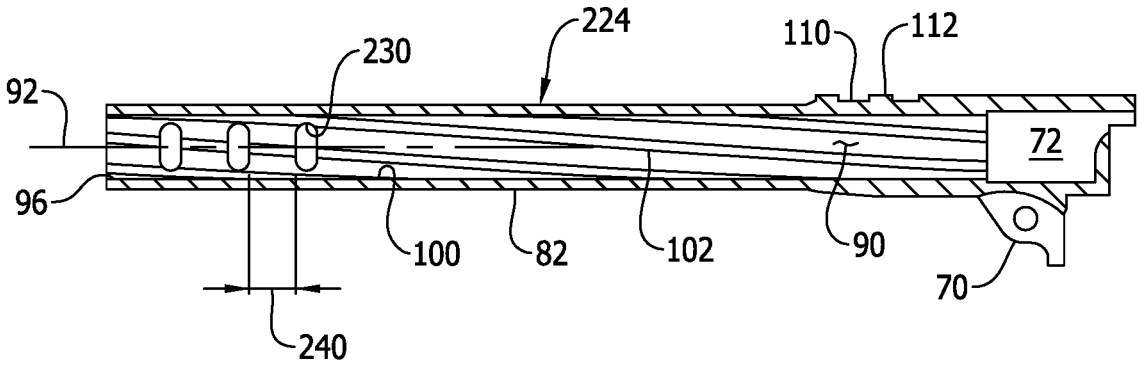
FIG. 4 is a cross section of a barrel of a firearm having a first described compensator.
Figure 5:
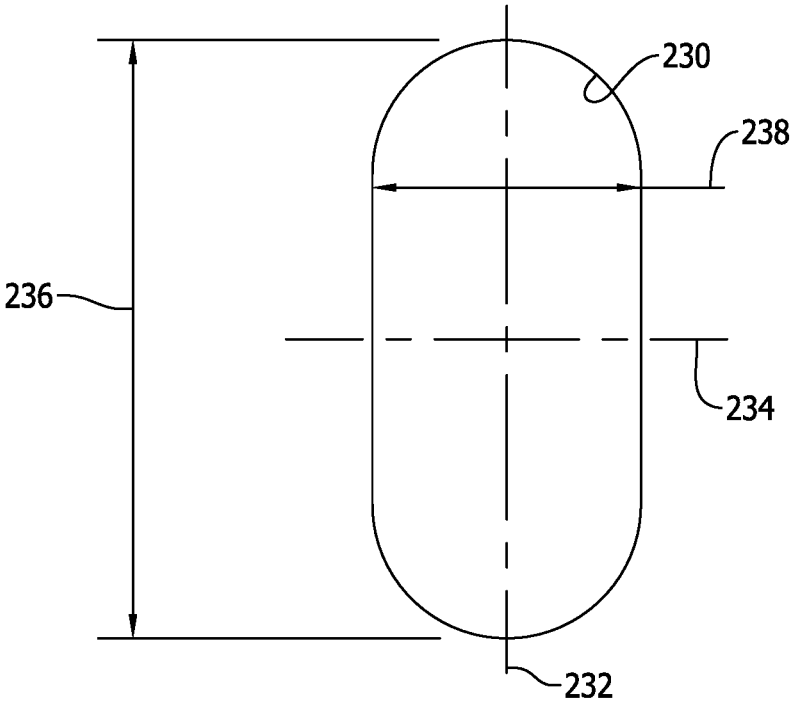
FIG. 5 is a detail of a slot shown in FIG. 4.

FIG. 4 illustrates a barrel 224 of a first configuration that may be used instead of the conventional barrel 24 described above. The barrel 224 of the first configuration is identical to the conventional barrel 24 except the barrel of the first configuration has a series of compensator slots (or, more broadly, ports) 230 spaced at equal intervals along the bore 90. As shown in FIG. 5, each compensator slot 230 has a racetrack-shaped cross section (or, more broadly, an oblong cross section) extending through the barrel 224 from the interior surface 100 to the exterior surface 82 of the barrel. The slots 230 allow expanding gases to travel laterally from the bore 90 when the user fires the firearm 20. Each slot 230 also provides a downstream surface that expanding gases impacts, causing loads on the barrel 224 in a direction generally opposite the recoil force similarly to expanding gases impacting baffles of some prior firearms. As shown in FIG. 5, the cross section of each slot 230 has a major axis 232 extending transverse to the central bore axis 92, and a minor axis 234 extending transverse to the major axis and parallel to the central bore axis. Further, the cross section of each slot 230 has a length 236 measured along the major axis at the interior surface 100 of the barrel 224 and a width 238 measured along the minor axis at the interior surface of the barrel. Although the ratio of length 236 to width 238 can vary, the width must be shorter than the length in the first configuration. Each adjacent pair of slots 230 is separated by a distance 170 that is greater than the width 238 of each adjacent slot. Further, it is noteworthy that although the helical rifling groove 102 may be interrupted by a slot 230, the rifling grooves extend to the aperture 96. Also, it is noteworthy that a portion of each slot 230 at the interior surface 100 is below the central bore axis 92. Although the cross section may vary in some alternative configurations, the cross section of each compensator slot 230 in the illustrated configuration has a uniform size and shape from the interior surface 100 to the exterior surface 82 of the barrel 224.

Figure 6:
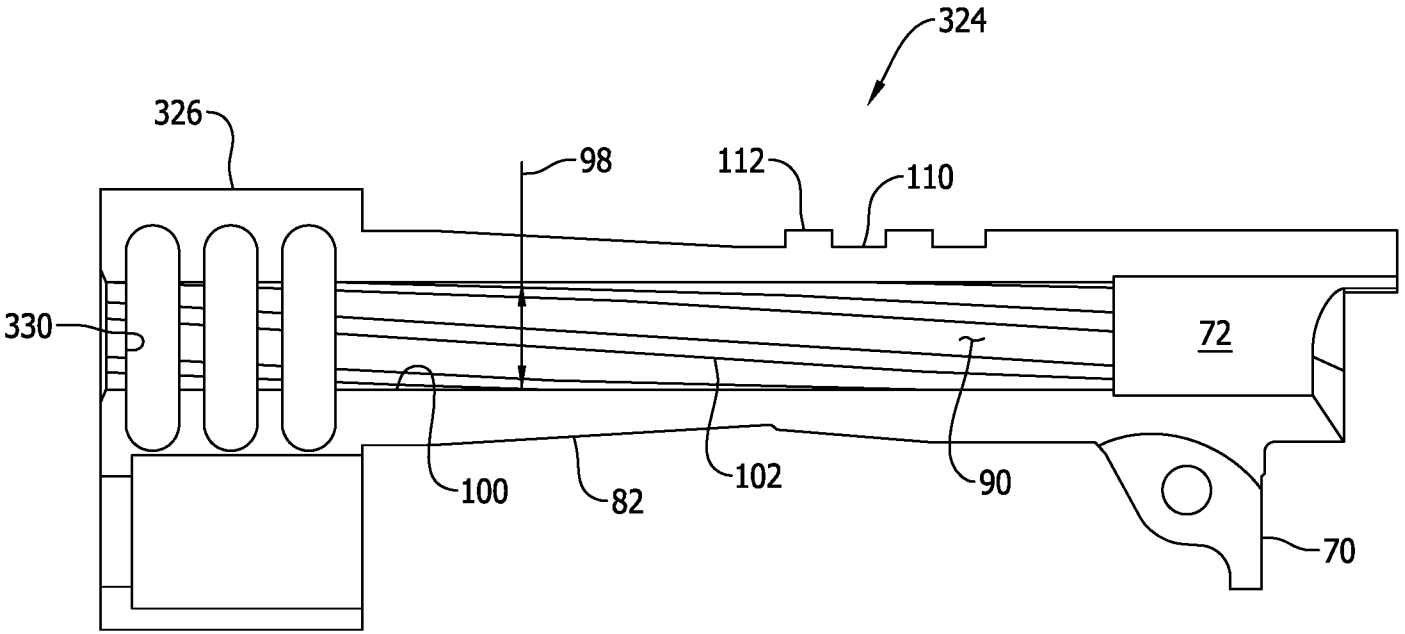
FIG. 6 is a cross section of a barrel of a firearm having a second described compensator.

FIG. 6 illustrates a barrel 324 of a second configuration that may be used instead of a conventional barrel. The barrel 324 of the second configuration is somewhat similar to the barrel 224 of the first configuration except that the barrel of the second configuration is shorter and has a compensator body 326 that is integral with the barrel rather than separable from the barrel as described above. Three racetrack-shaped slots 330 extend laterally through the bore 90. The slots 330 of the barrel 324 of the second configuration have lengths 230 that are longer than the diameter 98 of the bore 90. Therefore, gases can expand upward and downward in addition to traveling laterally from the bore 90 when the user fires the firearm 20. As a result, the barrel 324 of the second configuration provides downstream surfaces above and below the bore 90, as well as, downstream surfaces along the sides of the barrel that expanding gases impact. The larger the downstream surface area, the larger the loads developed on the barrel 324. The loads resulting from expanding gases impacting the downstream surfaces are generally opposite the recoil force. Somewhat notably, the ratio of slot length to slot width is larger for the barrel 324 of the second configuration than for the barrel 224 of the first configuration.

Figure 7:
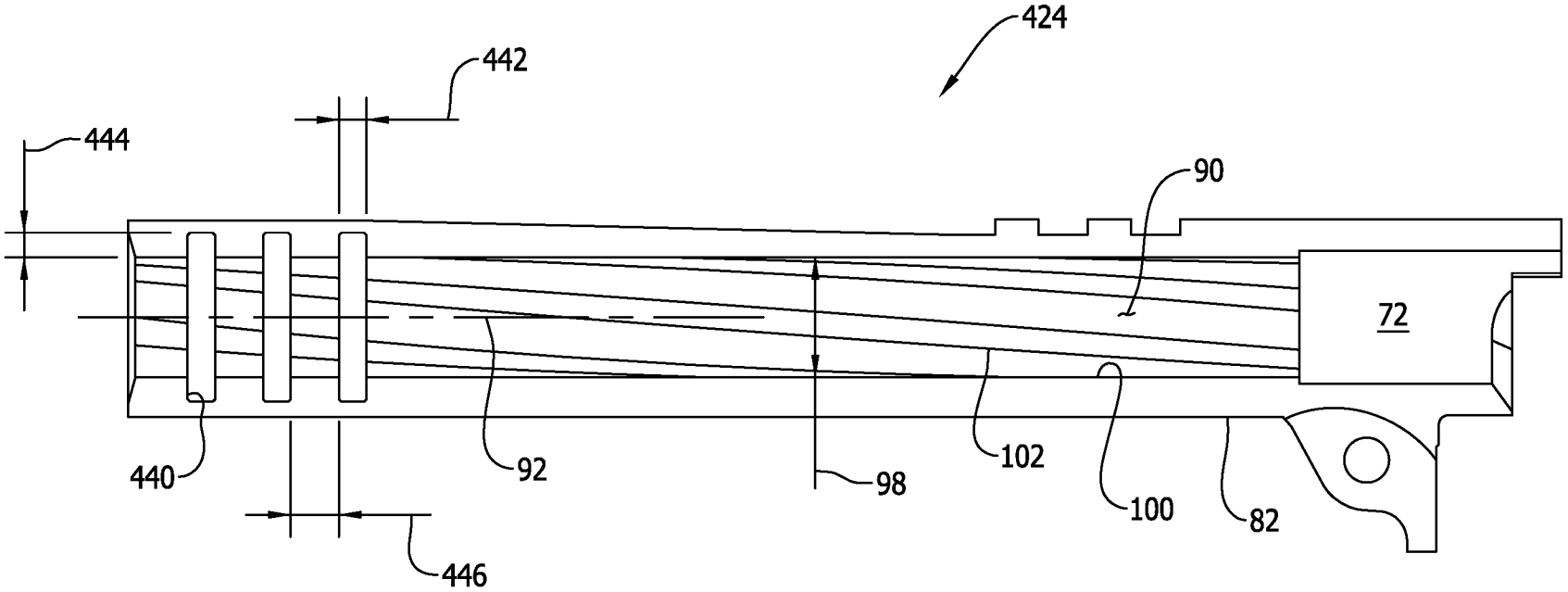
FIG. 7 is a cross section of a barrel of a firearm having a third described compensator.

As shown in FIG. 7, a barrel 424 of a third configuration includes expansion chambers 440 rather than ports. Each of the expansion chambers 440 allow gas to expand outwardly in all radial directions. Thus, the barrel 424 of the third configuration provides downstream surfaces completely around the bore 90 that expanding gases impact. As with slots, the larger the downstream surface area of the expansion chamber, the larger the loads developed on the barrel 424. The loads resulting from expanding gases impacting the downstream surfaces are generally opposite the recoil force. In some particular configurations, each expansion chamber 440 has a width 442 measured parallel to the central bore axis 92 that is no more than eighty percent of a bearing surface length of a bullet being fired. In other particular configurations, each expansion chamber 440 has a width 442 measured parallel to the central bore axis 92 that is no more than seventy percent of a bearing surface length of a bullet being fired. It is believed that these widths 442 are sufficient that the bullet will span the expansion chamber 440 as it passes and be supported such that eccentricities are not introduced into the bullet flight. Further, in most configurations, each expansion chamber 440 has a radial height 444 measured from the interior surface 100 of the barrel 424 that is greater than about 0.05 inch, which distinguishes the expansion chambers 440 from grooves found in some firearms. Also, in some configurations, each expansion chamber 440 has a downstream surface area of at least 0.35 square inches and/or a total volume of at least 0.035 cubic inches. Still further, in some configurations, each expansion chamber has a downstream surface area that is at least 1.2 times greater than the cross-sectional area of the bore. These dimensions and ratios are equally applicable to some variations of the other configurations described herein. It is noteworthy that each adjacent pair of expansion chambers 440 is separated by a distance 446 that is greater than the width 442 of each adjacent expansion chamber. Further, it is noteworthy that although the helical rifling groove 102 may be interrupted by an expansion chamber 440, the rifling grooves extend to the aperture 96. Rifling grooves 102 extending downstream from the expansion chambers 440 is particularly noteworthy as the grooves provide support for the bullet until it exits the aperture 96. Another noteworthy aspect is that the rifled bore of the baffle fully engages a passing bullet. A complete seal is formed between the bullet and rifled bore providing an attendant increase in gas stripping and efficiency over conventional designs having oversized, unrifled bores, which allow gas to bypass the bullet without impacting the face of the baffle. Although the cross section may vary in some alternative configurations, the cross section of each expansion chamber 440 in the illustrated configuration has a uniform size and shape entirely around the central bore axis 92.

It is envisioned that some configurations may lend themselves to non-symmetrical expansion chambers (e.g., a barrel having an underlug or a compensator that matches the slide profile) to maximize the area of the face of the baffle and thus the effectiveness of the compensator. Those skilled in the art will appreciate that a design having a relatively simple and robust integral compensator could likely be manufactured using conventional machining methods and rifled either before or after the machining of the compensator features using any number of rifling methods. Those designs incorporating removable rifled baffles are necessarily more complex and will likely require rifling of the assembled components after other machining. Further, it is envisioned that these designs could be rifled by electrochemical machining, electrical discharge machining, or similar low-stress methods. It is envisioned that still more complex designs could be produced by non-traditional methods such as 3D printing and laser sintering. Further, unless the rifling was incorporated in these non-traditional processes, the rifling would likely require subsequent electrochemical machining or other machining process after machining the other features.

Figure 8:
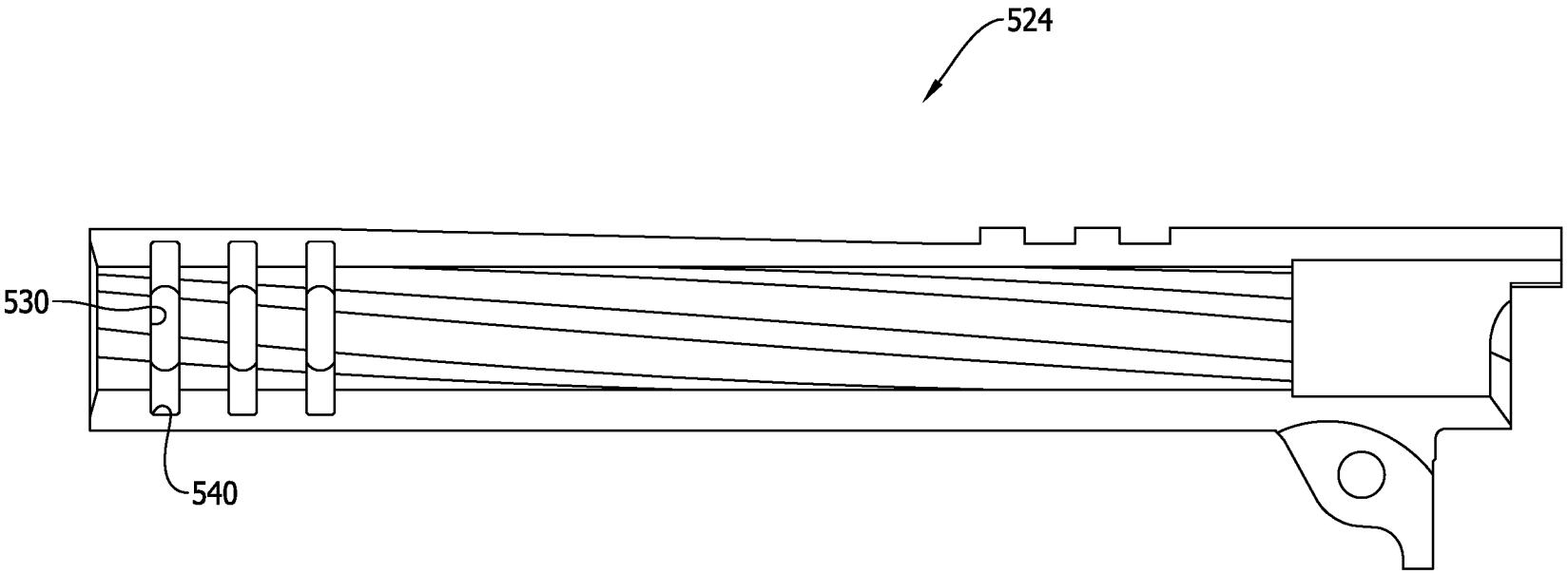
FIG. 8 is a cross section of a barrel of a firearm having a fourth described compensator.
Figure 9:
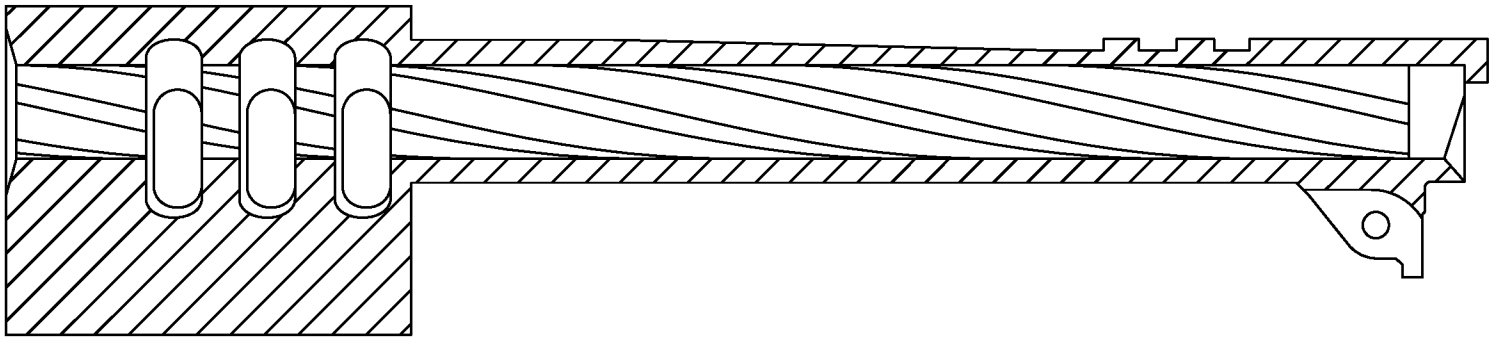
FIG. 9 is a cross section of a barrel of a firearm having a first variation of the fourth described compensator.
Figure 10:
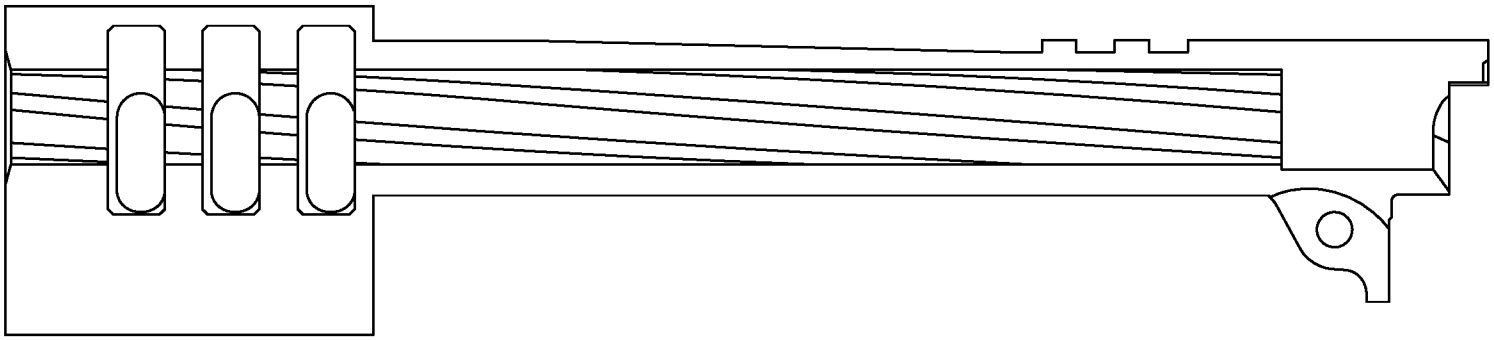
FIG. 10 is a cross section of a barrel of a firearm having a second variation of the fourth described compensator.
Figure 11:
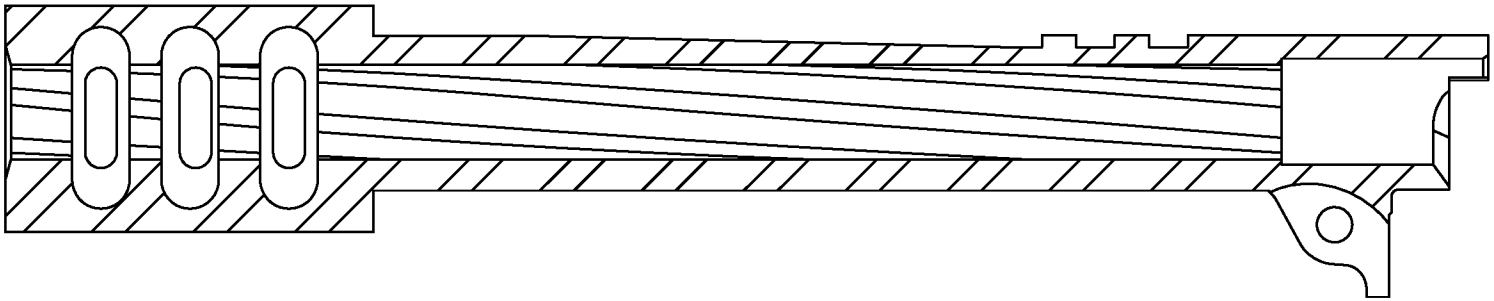
FIG. 11 is a cross section of a barrel of a firearm having a third variation of the fourth described compensator.
Figure 12:
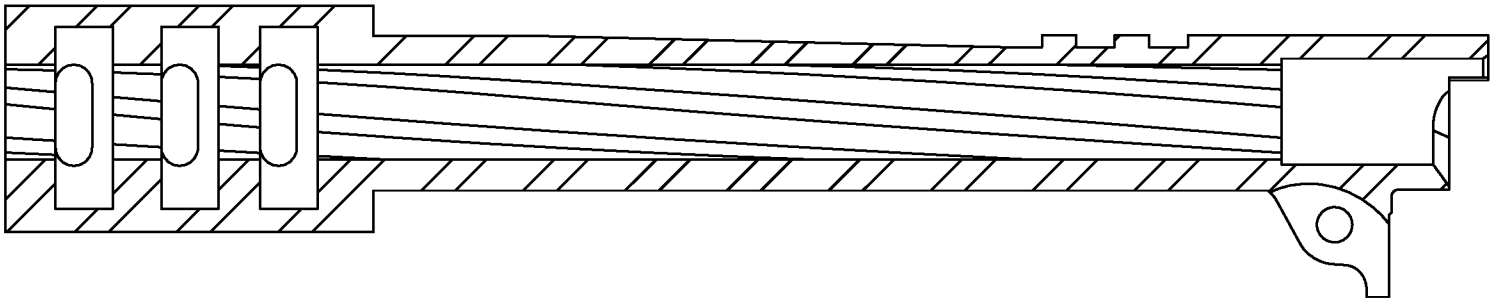
FIG. 12 is a cross section of a barrel of a firearm having a fourth variation of the fourth described compensator.
Figure 13:
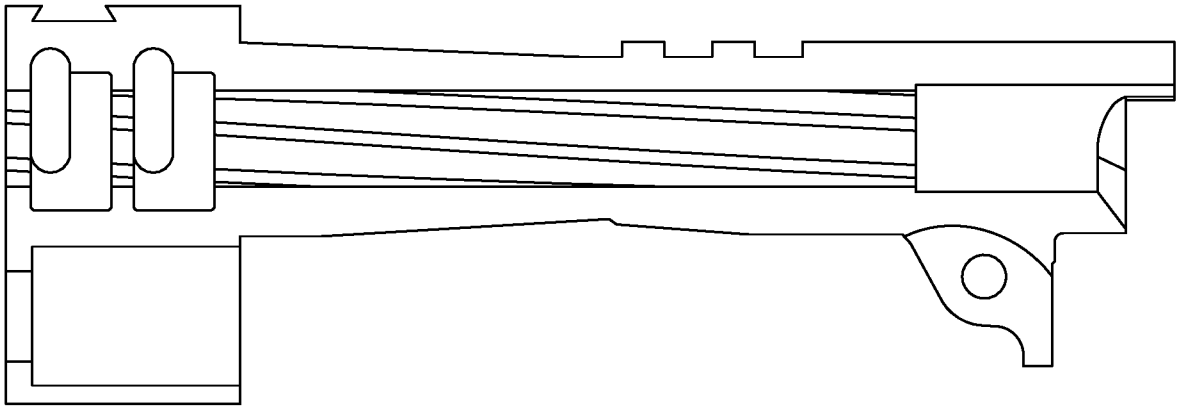
FIG. 13 is a cross section of a barrel of a firearm having a fifth variation of the fourth described compensator.

FIG. 8 shows a barrel 524 of a fourth configuration having slots 530 and expansion chambers 540. In this configuration, the width of each slot corresponds to the width of each expansion chamber 540. It is noteworthy that each slot 430 is centered on opposite sides of the central bore axis 92. As other features will be apparent to those skilled in the art, they will not be described in further detail. Each of the expansion chambers 440 allow gas to expand outwardly in all radial directions. Thus, the barrel 424 of the third configuration provides downstream surfaces completely around the bore 90. FIGS. 9-13 illustrate variations of barrels having slots and expansion chambers. In some variations, an upstream surface of each slot is aligned with an upstream surface of each expansion chamber. In other variations, each slot is generally centered between the upstream and downstream surfaces of each expansion chamber. In still other variations, the downstream surfaces of each slot and expansion chamber are aligned. Further, in some variations, most of each slot is below the central bore axis 92. In other variations, each slot is vertically centered on the central bore axis, or most of each slot is above the central bore axis 92. Also, the cross-sectional shapes of the expansion chambers and aspect ratios of the slots vary between FIGS. 9-13. Lastly, FIG. 13 shows a variation having only two slots and two expansion chambers. Other numbers of both are envisioned.

Figure 14:
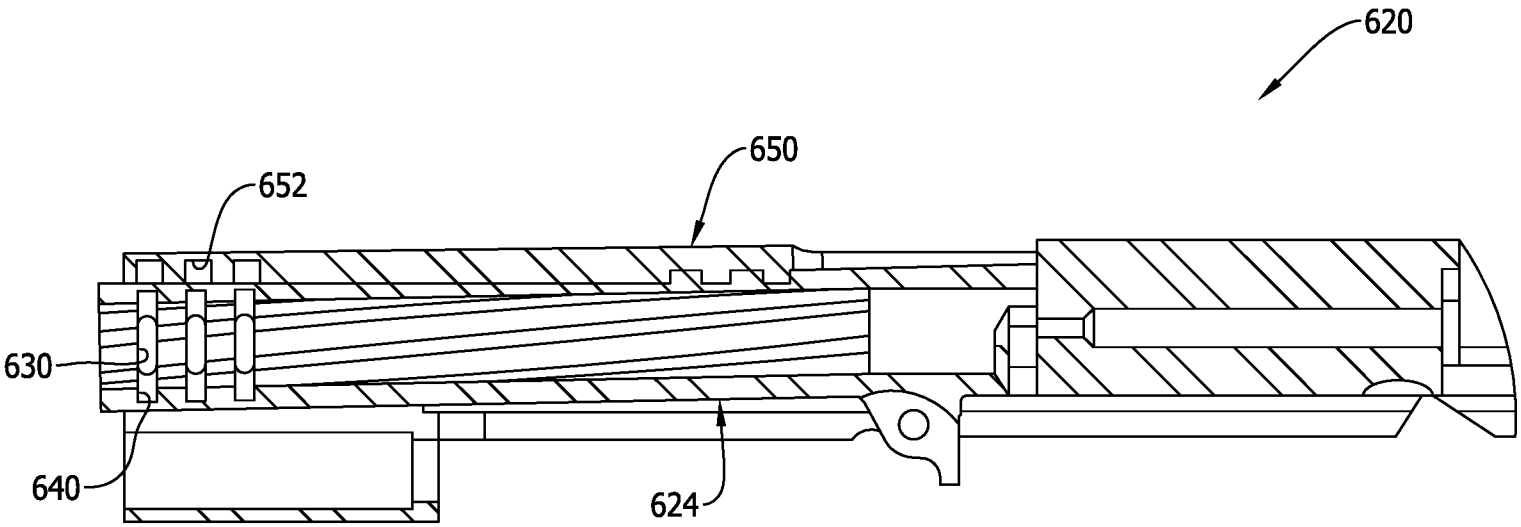
FIG. 14 is a cross section of a barrel and slide of a firearm having a fifth described compensator.
Figure 15:
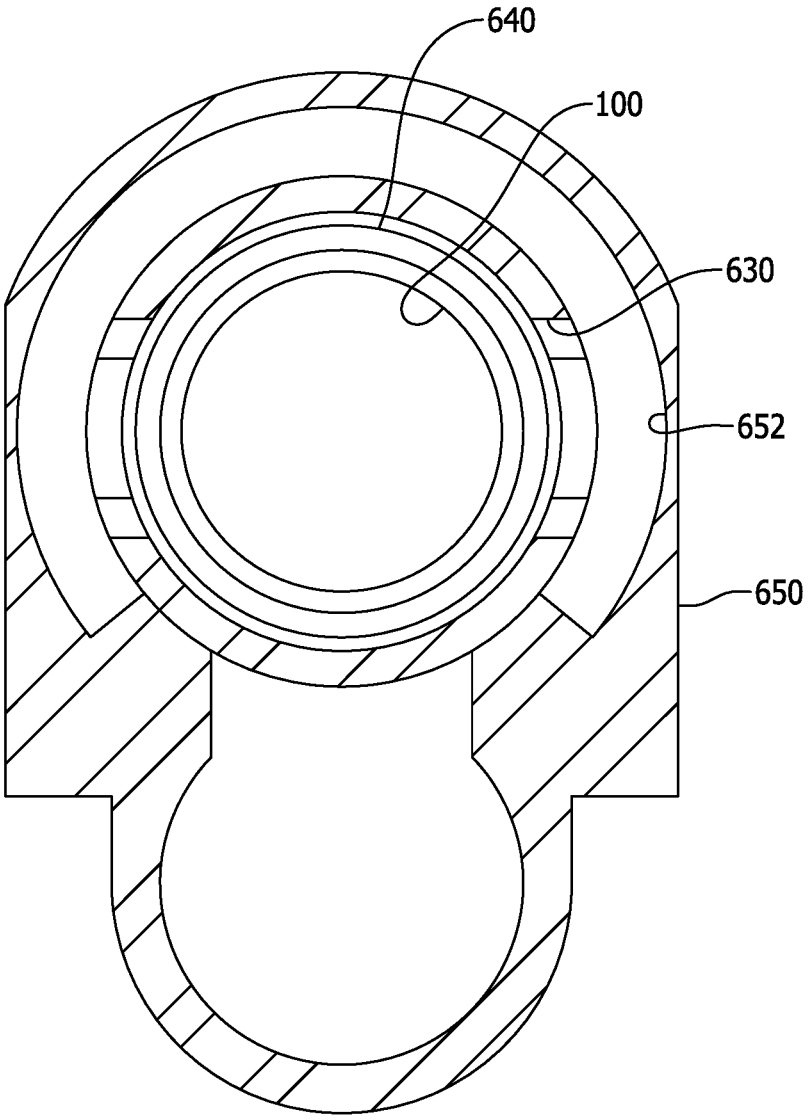
FIG. 15 a cross section of the barrel and slide of the fifth described compensator taken in the plane of line 15-15 of FIG. 14.
Figure 16:
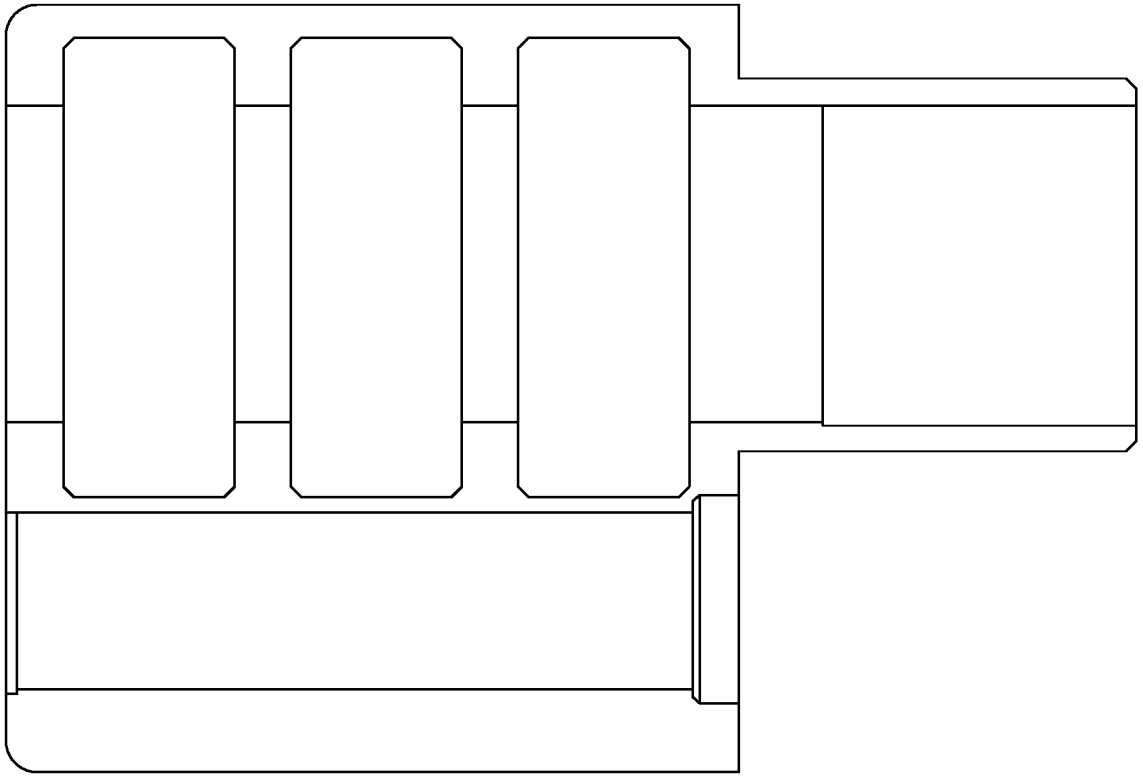
FIG. 16 is a cross section of a barrel bushing of a variation of the fifth described compensator.

As illustrated in FIG. 14, a fifth configuration of a compensator 620. The compensator has a barrel 624 similar to the barrel 524 of the fourth described configuration. The barrel 624 includes both slots 630 and expansion chambers 640, which provide the advantages described above with respect to the fourth described configuration. A slide 650 surrounding the barrel 624 also includes expansion chambers 652. Expanding gases are delivered to each expansion chamber 652 in the slide by the slots 630 in the barrel. As shown in FIG. 15, the expansion chambers 652 formed in the slide 650 extend only partially around the central bore axis 92. FIG. 16 shows a variation in which expansion chambers are formed in a barrel bushing rather than in the slide 650.

Figure 17:
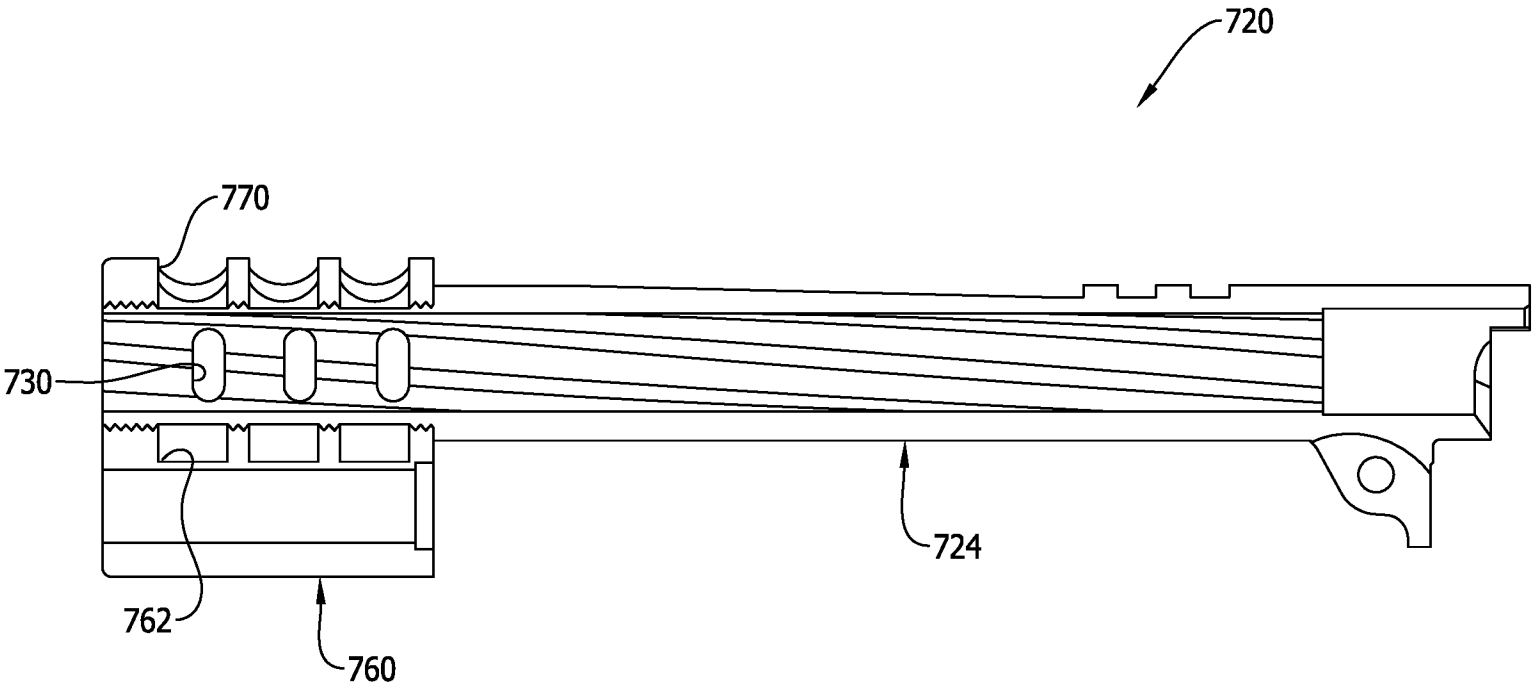
FIG. 17 is a cross section of a barrel and barrel bushing of a firearm having a sixth described compensator.
Figure 18:
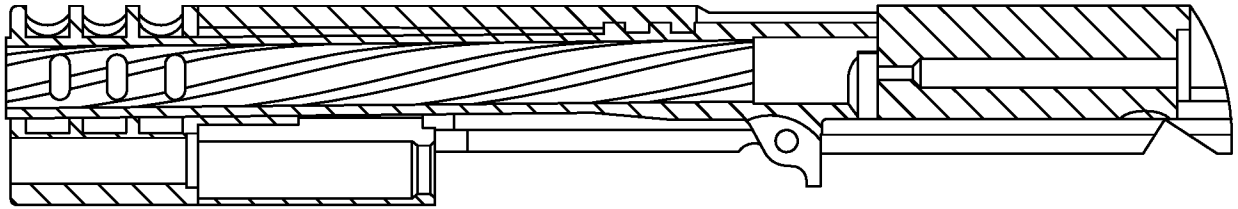
FIG. 18 is a cross section of a barrel and barrel bushing of a firearm having a variation of the sixth described compensator.

FIG. 17 illustrates a sixth configuration of a compensator 720 having a barrel 724 and a barrel bushing 760. The barrel 724 of the sixth configuration includes slots 730 similar to the barrel 24 of the first configuration. The bushing 760 includes expansion chambers 762 so expanding gases exiting the barrel 724 through the slots 730 enter the expansion chambers. Further, ports or vents 770 are provided from the top of the bushing expansion chambers 762. These ports 770 direct expanding gases upward, thereby providing downward propulsive forces to counteract the muzzle rise moment. As will be appreciated by those skilled in the art, the vents 770 may be provided in other surfaces of the bushing 760 and direct expanding gases in other directions depending upon the desired effect. In some configurations, threads are provided on the mating surfaces of the barrel 724 and bushing 760 to fasten the components together. Other conventional fastening systems are also envisioned. For example, the bushing may be held on the barrel by a keeper tab (not shown). This variation is illustrated in FIG. 18.

Figure 19:
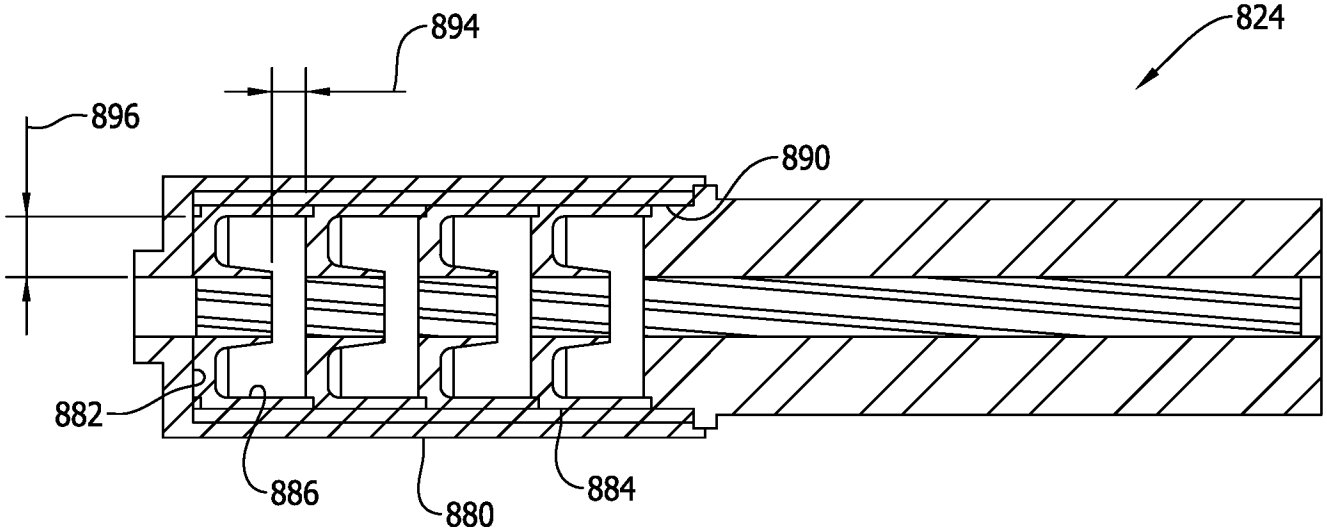
FIG. 19 is a cross section of a barrel of a firearm having a seventh described compensator.
Figure 20:
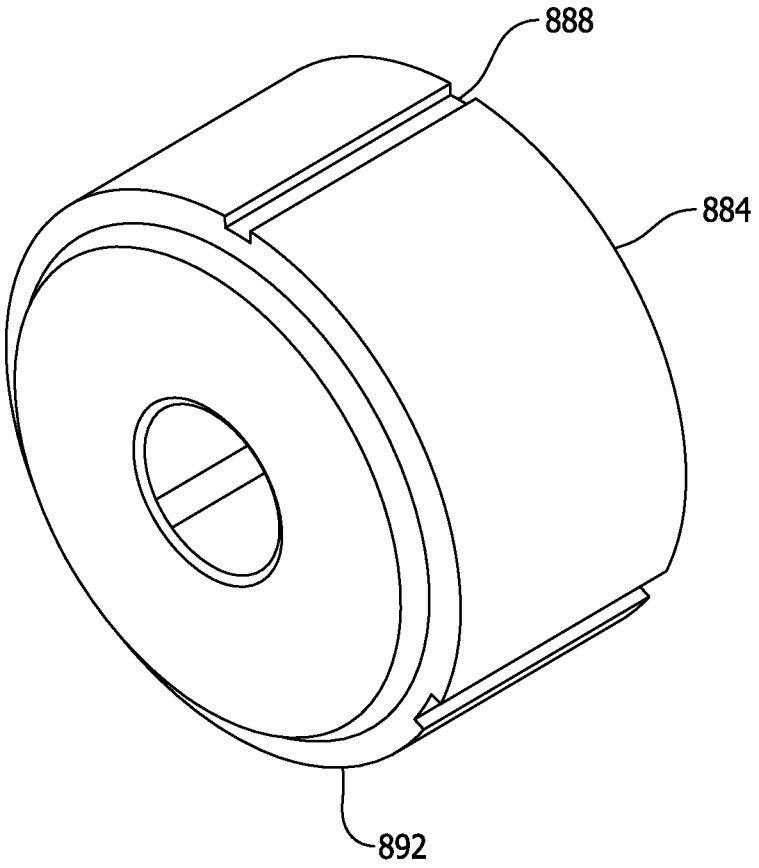
FIG. 20 is a perspective of a baffle insert of the barrel of the firearm having the seventh described compensator.
Figure 21:
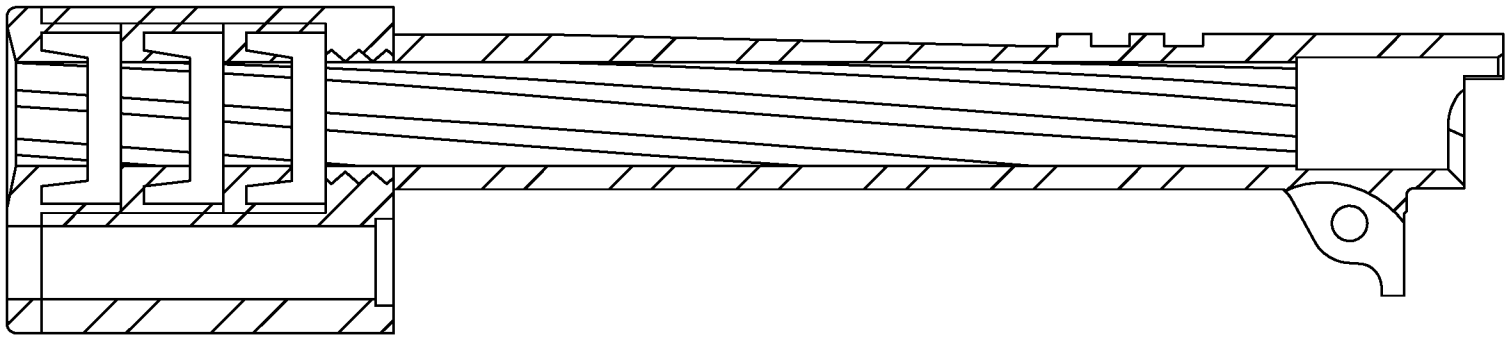
FIG. 21 is a cross section of a barrel and barrel bushing of a firearm having a variation of the seventh described compensator.
Figure 22:
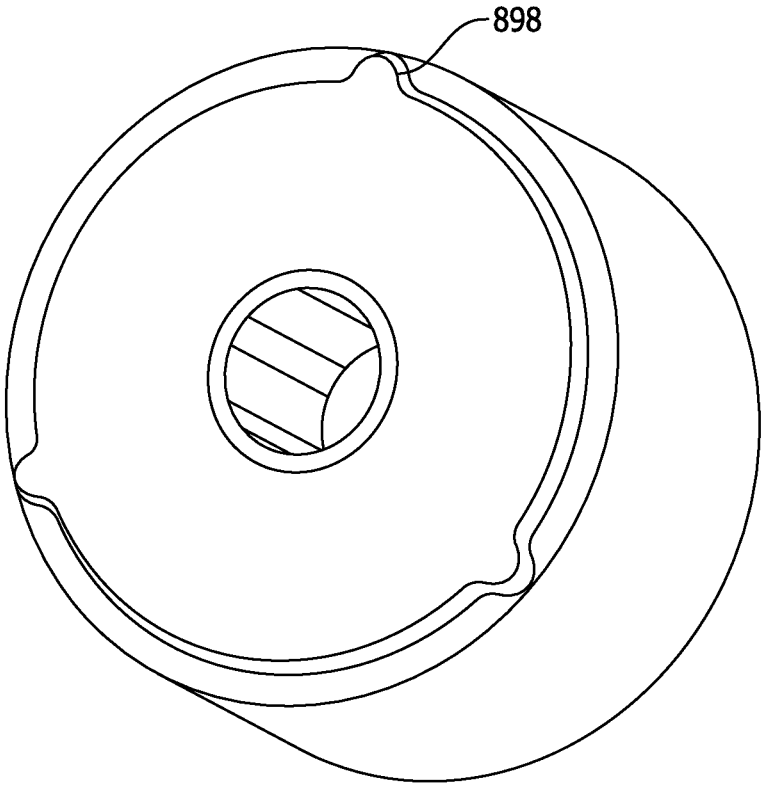
FIG. 22 is a perspective of a baffle insert of the barrel of the firearm having the variation of FIG. 21.
Figure 23:
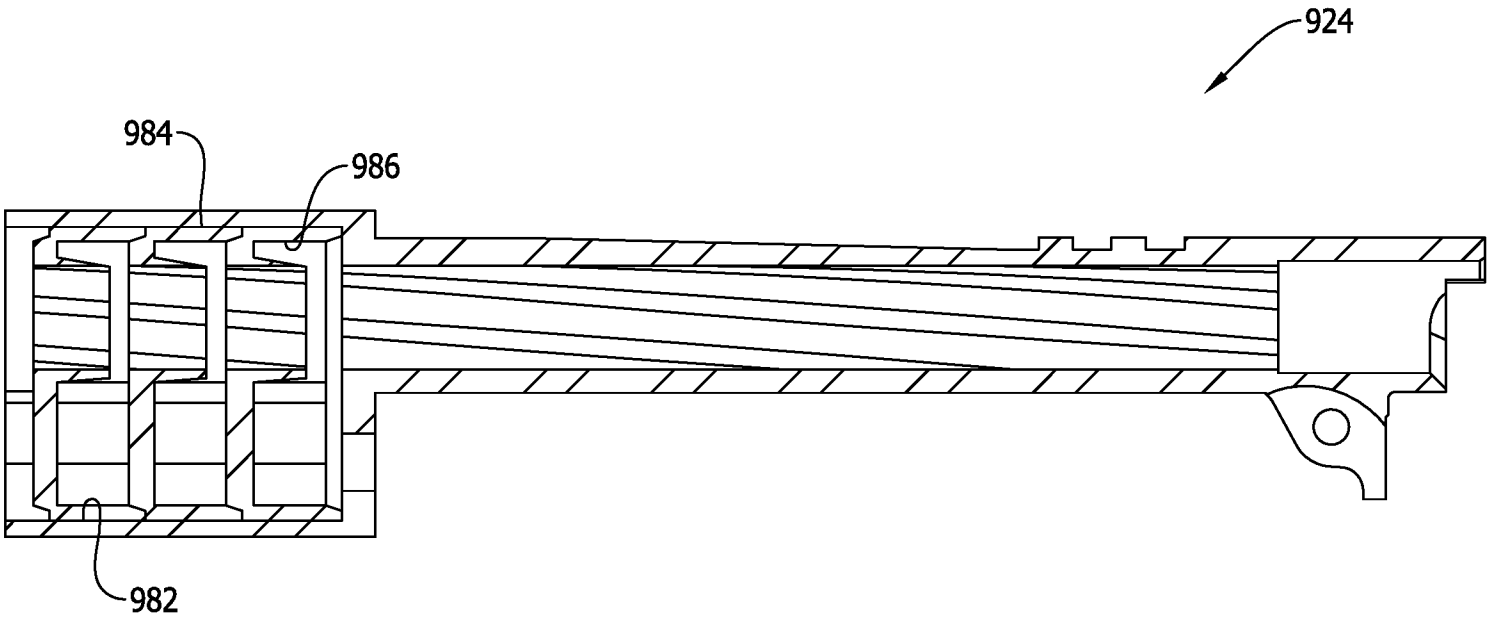
FIG. 23 is a cross section of a barrel of a firearm having an eighth described compensator.
Figure 24:
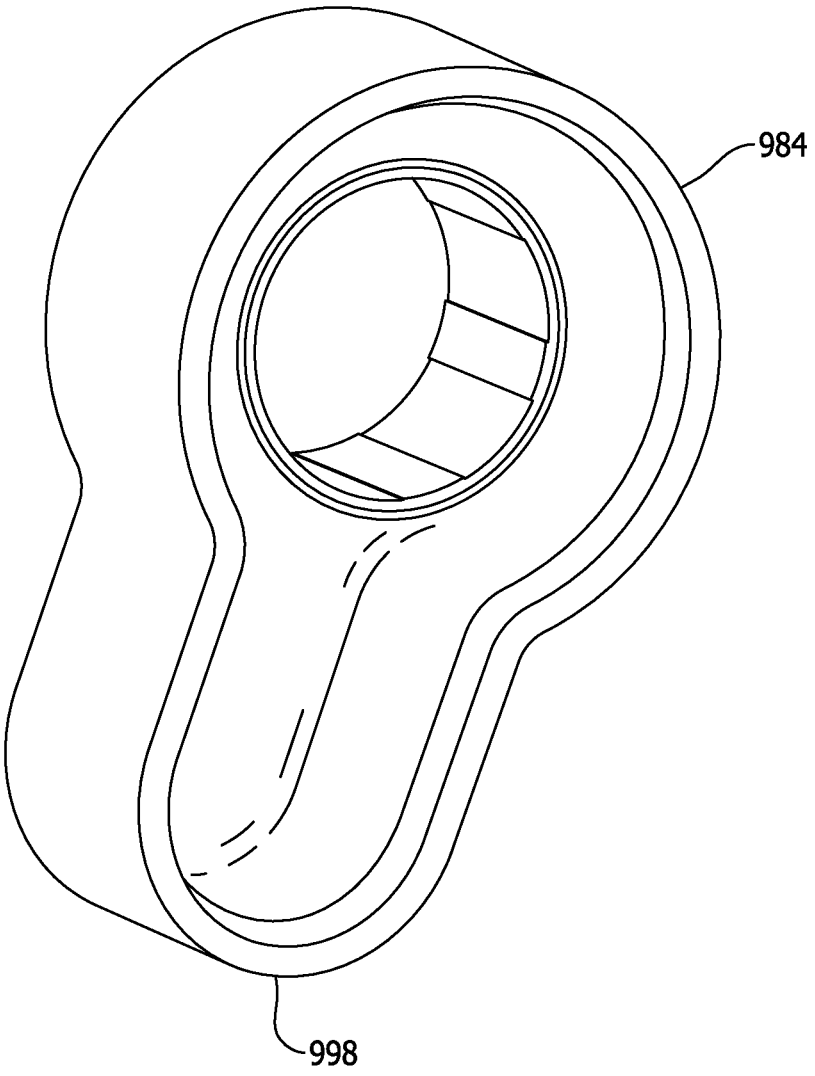
FIG. 24 is a perspective of a baffle insert of the barrel of the firearm having the eighth described compensator.

As illustrated in FIG. 19, a seventh configuration of a barrel 824 receives a compensator body 880 at its forward end. The compensator body 880 has a cavity 882 sized and shaped for receiving a series of rifled baffle members or inserts 884. The baffle members 884 form expansion chambers 886 that allow gases to expand radially in all directions around the bore 90 when the user fires the firearm 20. As shown in FIG. 20, the compensator bodies 884 include one or more axial grooves 888 that receive corresponding axial ribs 890 extending into the compensator body cavity 882. The interengaging ribs 890 and grooves 888 ensure rifling 890 in the baffle members 884 is properly clocked around the central bore axis 92. It is envisioned similar grooves could be formed at the forward end of the barrel 824 to ensure proper clocking between the bore rifling and the baffle member rifling. Further, a forward face of each baffle member 884 has a shoulder, or in some configurations, a chamfer 892 that engages the adjacent downstream baffle member 884 to ensure the baffle members 884 are precisely aligned. This configuration also allows the baffle members 884 to maintain an effective gas seal between the members when axially clamped and allows for disassembly even after residue build-up caused by extended use. In some particular configurations, each expansion chamber 886 has a width 894 measured parallel to the central bore axis 92 at the interior surface 100 of the bore 90 that is no more than eighty percent of a bearing surface length of a bullet being fired. In other particular configurations, each expansion chamber 886 has a width 894 that is no more than seventy percent of a bearing surface length of a bullet being fired. It is believed that these widths 894 are sufficient that the bullet will span the expansion chamber 886 as it passes and be supported such that eccentricities are not introduced into the bullet flight. Further, in some configurations, each expansion chamber 886 has a radial height 896 measured from the interior surface 100 of the barrel 824 that is greater than about 0.05 inch, which distinguishes the expansion chambers 886 from grooves found in some firearms. In other configurations, each expansion chamber has a radial height 894 that is greater than about 0.07 inch. In most configurations, each expansion chamber has a radial height 894 that is greater than about 0.10 inch. These dimensions are equally applicable to some variations of the other configurations described herein. FIG. 21 illustrates a variation of the compensator of the seventh configuration. This variation includes clocking features on the forward and rearward faces of the baffle members and the forward end of the barrel to ensure the rifling is properly oriented between the barrel and the baffle members. In some configurations, these clocking features include nodes 898 positioned on the downstream face and corresponding recesses (not shown) on the upstream rims of the baffle members FIG. 23 shows an eighth configuration of a barrel 924 having a larger housing at its forward end that serves a similar purpose as the compensator body 880 of the seventh configuration. The housing has a cavity 982 sized and shaped for receiving a series of rifled baffle members or inserts 984. Rather than being generally cylindrical as those of the seventh configuration, each baffle member 984 of the eighth configuration includes a large lobe 998 as shown in FIG. 24. The cavity 982 has a corresponding shape that prevents the baffle members 984 from rotating, and that ensures the rifling is properly clocked. Otherwise, the features of the baffle members 984 are similar to those of the baffle members 884 of the seventh configuration and are not described in further detail.

Although the baffle members described above all include rifling, it is envisioned that rifling may be omitted from some or even all of the baffle members in some configurations. These configurations are intended to be within the scope of this description.

Figure 25:
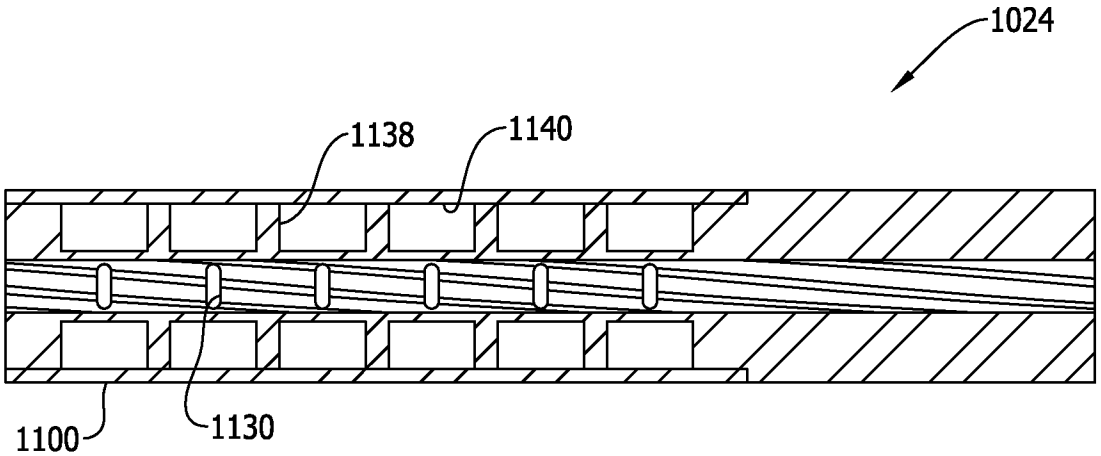
FIG. 25 is a cross section of a barrel of a firearm having a ninth described compensator.

FIG. 25 schematically illustrates a barrel 1024 of a ninth configuration having a cover 1100. The barrel 1024 has a series of slots 1130. Baffles 1138 extend outward from the exterior surface of the barrel 1024 between the slots 1130. The cover 1100 fits closely over the baffles 1138, forming expansion chambers 1140 outside the bore 90. Passages (not shown) may be formed through the baffles 1138 to allow gases to travel between the expansion chambers 1140. It is envisioned that these passages may be formed at different clock positions in adjacent baffles 1138, potentially reducing noise emitted by the firearm. It is further envisioned that the expansion chambers may be filled with sound dampening materials to further reduce noise emitted by the firearm.

As those skilled in the art will appreciate, the components and firearms described above may be made from any suitable material and using suitable conventional and non-traditional methods and techniques. For example, it is envisioned that the components may be made using 3D printing, laser sintering, milling, and electrical discharge machining.

It will be apparent that modifications and variations are possible without departing from the scope of the invention defined in the appended claims.

Although the configurations described above are directed to compensators, it is apparent that the configurations are also applicable to muzzle brakes, suppressors, and silencers. Thus, these devices are intended to be within the scope of this description, and the term "compensator" as used in this description is intended to encompass these devices.

When introducing elements of the present invention or the description, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting.

What is claimed is:

1. A firearm component for a firearm, said firearm component comprising an elongate barrel having a generally cylindrical interior surface defining a bore extending along a central bore axis to a generally circular aperture at a forward end of the barrel through which a projectile is shot when the firearm is fired, said bore and aperture sharing a common bore diameter, the interior surface having a helical rifling groove extending along the interior surface around the central bore axis, said barrel having a series of compensator slots spaced at equal intervals along the bore, each compensator slot in said series of compensator slots having an obround cross section and extending through the barrel from the interior surface to an exterior surface of the barrel allowing vas to travel through said slot from the bore when the firearm is fired, the cross section having:

a major axis extending along a lengthwise midline of the compensator slot;

a minor axis extending orthogonal to the major axis midway along the compensator slot and parallel to the central bore axis;

a length measured along the major axis at the interior surface of the barrel; and a width measured along the minor axis at the interior surface of the barrel that is shorter than the length, and wherein:

the interval between each adjacent pair of slots in said series of compensator slots has a width at the interior surface of the barrel greater than the width of each slot in said adjacent pair of slots;

the helical rifling groove extends to the aperture; and at least a portion of the cross section extends below the central bore axis.

2. A firearm component as recited in claim 1, wherein:

the elongate barrel has a series of chambers extending circumferentially around the bore and spaced at axial intervals along the bore; and at least one chamber of said series of chambers axially overlaps at least one compensator slot of said series of compensator slots allowing gas in the bore to travel outward into the chamber and circumferentially along the chamber and into said overlapped compensator slot when the firearm is fired.

3. A firearm component as recited in claim 2, wherein:

the series of compensator slots consists of a number of slots; the series of chambers consists of a number of chambers equal to the number of slots; and each chamber in the series of chambers axially overlaps a corresponding slot of said series of compensator slots.

4. A firearm component as recited in claim 1, wherein the cross section of each compensator slot in said series of compensator slots has a uniform size and shape from the interior surface to the exterior surface of the barrel.

5. A firearm component as recited in claim 1, further comprising a housing releasably connected to the elongate barrel, said housing having a series of chambers extending circumferentially around the barrel and spaced at intervals along the housing, at least one chamber of said series of chambers axially overlaps at least one compensator slot of said series of compensator slots allowing gas in the bore to travel outward through said overlapped compensator slot and into the overlapping chamber.

6. A firearm component as recited in claim 5, wherein the housing includes a vent extending upward from the overlapping chamber to vent gas from the overlapping chamber, the vent directing gas upward to counter forces exerted on the firearm when the projectile is shot through the barrel bore.

7. A firearm component as recited in claim 6, wherein the housing forms a forward portion of a slide for chambering the projectile in line with the barrel bore in preparation of firing the firearm.

8. A firearm component for a firearm, said firearm component comprising an elongate barrel having a generally cylindrical interior surface defining a bore extending along a central bore axis to a generally circular aperture at a forward end of the barrel through which a projectile is shot when the firearm is fired, said bore and aperture sharing a common bore diameter, the interior surface having a helical rifling groove extending along the interior surface around the central bore axis to the aperture, said barrel having a first series of compensator slots spaced at intervals along the bore and a second series of compensator slots spaced at intervals along the bore, each slot in said first series of compensator slots being on a first side of an imaginary plane including the central axis and each slot in said second series of compensator slots being positioned on a second side of the imaginary plane opposite said first side, each compensator slot in said first and second series of compensator slots having an obround cross section and extending through the barrel from the interior surface to an exterior surface of the barrel allowing gas to travel through said slot from the bore when the firearm is fired, the cross section having;

a major axis extending along a lengthwise midline of the compensator slot;

a minor axis extending orthogonal to the major axis midway along the compensator slot and parallel to the central bore axis;

a length measured along the major axis at the interior surface of the barrel that is greater than about sixty percent of the bore diameter; and a width measured along the minor axis at the interior surface of the barrel that is less than about seventy percent of the bore diameter, the width being shorter than the length.

9. A firearm component as recited in claim 8, wherein:

the elongate barrel has a series of chambers extending circumferentially around the bore and spaced at axial intervals along the bore; and at least one chamber groove of said series of chambers axially overlaps at least one compensator slot of said first and second series of compensator slots allowing gas in the bore to travel outward into the chamber and circumferentially along the chamber and into said overlapped compensator slot when the firearm is fired.

10. A firearm component as recited in claim 9, wherein:

the series of chambers consists of a number of chambers;

the first series of compensator slots consists of a first number of slots equal to the number of chambers;

the second series of compensator slots consists of a second number of slots equal to the first number of slots; and each chamber barrel in the series of chambers axially overlaps a corresponding slot of said first series of compensator slots and a corresponding slot of said second series of compensator slots.

11. A firearm component as recited in claim 10, wherein:

each chamber in the series of chambers has an equal chamber width; and the equal chamber width of each chamber is wider than the width of obround section of said corresponding overlapped compensator slot of said first series of compensator slots and the width of the obround cross section of said corresponding overlapped compensator slot of said second series of compensator slots.

12. A firearm component as recited in claim 8, further comprising a housing releasably connected to the elongate barrel, said housing having a series of chambers extending circumferentially around the barrel and spaced at intervals along the housing, at least one chamber of said series of chambers axially overlaps at least one compensator slot of said first and second series of compensator slots allowing gas in the bore to travel outward through said overlapped compensator slot and into the overlapping chamber.

13. A firearm component as recited in claim 12, wherein the housing includes a vent extending from the overlapping chamber to vent gas from the overlapping chamber.

14. A firearm component as recited in claim 13, wherein the vent directs gas upward to counter forces exerted on the firearm when the projectile is shot through the barrel bore.

15. A firearm component as recited in claim 13, further comprising a connector for releasably connecting the housing directly to the elongate barrel.

16. A firearm component as recited in claim 13, wherein the housing forms a forward portion of a slide for chambering the projectile in line with the barrel bore in preparation of firing the firearm.

17. A firearm component for a firearm, said firearm component comprising an elongate barrel having a generally cylindrical interior surface defining a bore extending along a central bore axis to a generally circular aperture at a forward end of the barrel through which a projectile is shot when the firearm is fired, said bore and aperture sharing a common bore diameter, the interior surface having a helical rifling groove extending along the interior surface around the central bore axis to the aperture, said barrel having a series of compensator slots spaced at intervals along the bore, each compensator slot in said series of compensator slots having an oblong cross section and extending through the barrel along a slot axis from the interior surface to an exterior surface of the barrel allowing gas to travel through said slot from the bore when the firearm is fired, and each compensator slot in the series of compensator slots has a forward slot face extending radially from the interior surface to the exterior surface of the barrel and a rearward slot face opposite the forward slot face extending parallel to the forward slot face, the cross section of each compensator slot in the series of compensator slots having a major axis extending along a lengthwise midline of the compensator slot, a minor axis extending orthogonal to the major axis midway along the compensator slot and parallel to the central bore axis, a length measured along the major axis at the interior surface of the barrel, a width measured along the minor axis at the interior surface of the barrel that is shorter than the length, and at least a portion of the cross section extends below the central bore axis.

18. A firearm component as recited in claim 17, wherein:

the cross of each compensator slot in the series of compensator slots has a uniform size and a uniform shape along the slot axis from the interior surface to the exterior surface of the barrel; and the slot axis of each compensator slot in the series of compensator slots extends radially from the interior surface to the exterior surface of the barrel.

19. A firearm component as recited in claim 17, wherein:

the elongate barrel has a series of chambers extending circumferentially around the bore and spaced at axial intervals along the bore, at least one chamber of said series of chambers axially overlaps at least one compensator slot of said series of compensator slots allowing gas in the bore to travel outward into the chamber and circumferentially along the chamber and into said overlapped compensator slot when the firearm is fired.

20. A firearm component as recited in claim 19, wherein:

the series of compensator slots consists of a number of slots; the series of chambers consists of a number chambers equal to the number of slots; and each chamber in the series of chambers axially overlaps a corresponding slot of said series of compensator slots.

21. A firearm component as recited in claim 17, wherein the cross section of each compensator slot in said series of compensator slots has a uniform size and shape from the interior surface to the exterior surface of the barrel.

22. A firearm component as recited in claim 17, further comprising a housing releasably connected to the elongate barrel, said housing having a series of chambers extending circumferentially around the barrel and spaced at intervals along the housing, at least one chamber of said series of chambers axially overlaps at least one compensator slot of said series of compensator slots allowing gas in the bore to travel outward through said overlapped compensator slot and into the overlapping chamber.

23. A firearm component as recited in claim 22, wherein the housing includes a vent extending upward from the overlapping chamber to vent gas from the overlapping chamber, the vent directing gas upward to counter forces exerted on the firearm when the projectile is shot through the barrel bore.

24. A firearm component as recited in claim 22, wherein the housing forms a forward portion of a slide for chambering the projectile in line with the barrel bore in preparation of firing the firearm.

* * * * *